US007645351B2

(12) United States Patent
Ohno et al.

(10) Patent No.: US 7,645,351 B2
(45) Date of Patent: Jan. 12, 2010

(54) EXPLOSIVE MATERIAL COMPOSITION AND METHOD FOR PREPARING THE SAME

(75) Inventors: Yoshio Ohno, Handa (JP); Kazuya Serizawa, Handa (JP); Katsuhiko Takahashi, Aichi-ken (JP)

(73) Assignee: NOF Corporation, Tokyo (JP)

( * ) Notice: Subject to any disclaimer, the term of this patent is extended or adjusted under 35 U.S.C. 154(b) by 283 days.

(21) Appl. No.: 10/978,603

(22) Filed: Nov. 1, 2004

(65) Prior Publication Data

US 2005/0189049 A1 Sep. 1, 2005

(30) Foreign Application Priority Data

Nov. 4, 2003 (JP) ..... 2003-374786

(51) Int. Cl.
*C06B 45/00* (2006.01)
*C06B 31/28* (2006.01)

(52) U.S. Cl. ..... 149/2; 149/46

(58) Field of Classification Search ..... 149/2, 149/9, 11, 46, 60, 109.6; 264/3.4
See application file for complete search history.

(56) References Cited

U.S. PATENT DOCUMENTS

| | | | | | |
|---|---|---|---|---|---|
| 3,685,163 | A | * | 8/1972 | Olt | 34/295 |
| 3,788,095 | A | | 1/1974 | Murphy, Jr. et al. | |
| 4,543,137 | A | * | 9/1985 | Edamura et al. | 149/21 |
| 4,555,278 | A | * | 11/1985 | Cescon et al. | 149/21 |
| 4,736,683 | A | * | 4/1988 | Bachman et al. | 102/290 |
| 2004/1002057 | | * | 2/2004 | Pollack | 149/46 |

FOREIGN PATENT DOCUMENTS

| | | | |
|---|---|---|---|
| JP | 8-104588 | A | 4/1996 |
| JP | 2000-143380 | | 5/2000 |
| JP | 2001-26490 | | 1/2001 |
| JP | 2001048689 | A * | 2/2001 |
| WO | WO 98/29361 | A1 | 7/1998 |

* cited by examiner

*Primary Examiner*—Aileen Felton
(74) *Attorney, Agent, or Firm*—Crompton, Seager & Tufte, LLC

(57) ABSTRACT

An explosive material composition containing, as an active ingredient, particles of a water-soluble reactive ingredient having an uniform particle size. Each particle is coated with an oil ingredient and/or a thickener. The coated particles form an agglomerate.

16 Claims, 2 Drawing Sheets

EXPLOSIVE MATERIAL COMPOSITION AND METHOD FOR PREPARING THE SAME

CROSS-REFERENCE TO RELATED APPLICATIONS

This application is based upon and claims the benefit of priority from prior Japanese Patent Application No. 2003-374786, filed on Nov. 4, 2003, the entire contents of which are incorporated herein by reference.

BACKGROUND OF THE INVENTION

The present invention relates to an explosive material composition and a method for producing the same. The explosive material composition of the present invention can be used for explosives which generate gas and/or heat upon combustion, such as a gun propellant, a propellant, a gas generating agent and a pyrotechnic composition. The explosive material composition of the present invention is not directed to a detonating explosive that causes detonation.

Explosive material compositions generally contain solid reactive ingredients. The smaller the size of the solid reactive ingredient is, the larger the surface area, whereby a higher burn rate of the explosive is achieved. Conventionally, an oxidizing agent, which is one of the solid reactive ingredients, is prepared as fine particles. The method of making fine particles includes a pulverization method and a spray drying method. In the pulverization method, for example, after adding an anticoagulant to an oxidizing agent such as strontium nitrate, the oxidizing agent is pulverized. According to the pulverization method, particles of oxidizing agent having an average particle size of 5 to 80 μm.

International Patent Publication No. WO 98/29361 discloses a method of producing a gas generating agent using the pulverization method. In the method of making fine particles of oxidizing agent using a pulverizing apparatus, obtaining particles of oxidizing agent having an average particle size of less than 5 μm is difficult. Even if the particles of oxidizing agent having an average particle size of less than 5 μm are obtained, the fine particles form an agglomerate (see Japanese Laid-Open Patent Publication No. 8-104588). Since the size of the agglomerate is relatively large and influences the properties of explosives including burn rate, the substance is not preferable as an explosive material composition.

U.S. Pat. No. 3,788,095 discloses a spray drying method in which a solution of ammonium perchlorate is sprayed in a cooled chamber to freeze-dry the small droplets of ammonium perchlorate. Japanese Laid-Open Patent Publication No. 8-104588 discloses a technique in which a solution comprising ammonium nitrate, polyacrylamide and water is sprayed in a cooled gas to coagulate and freeze-dry the droplets of the solution. According to the technique, agglomerates having a diameter of 50 to 200 μm comprised of a large number of ammonium nitrate crystals each having a size of 0.5 to 1 μm can be obtained.

The spray drying method, however, requires a coolant, and in order to make fine droplets by spraying, a solution having a low viscosity is necessary. To lowering the viscosity of the solution, a large amount of solvent is necessary. For example, Japanese Laid-Open Patent Publication No. 8-104588 uses water in an amount about 8 times the amount in weight ratio of ammonium nitrate. As the solvent is removed in a large amount when freeze-drying, the agglomerate of ammonium nitrate has micropores about 50% with respect to the volume of the agglomerate. When the agglomerate of oxidizing agent is porous, the bulk density of explosive is decreased, and the amount of chargeable explosive per unit volume is decreased. In addition, since freeze-drying sublimes frozen water in the agglomerate, the content of water in the agglomerate is relatively low. It is technically difficult to mold such agglomerate and the applicable method for the molding is limited to a press method. An extruding method is not applicable.

When an aqueous solution of a binder, such as a thickener, is added to the agglomerate obtained by a pulverization method and a spray drying method, water-soluble oxidizing agent dissolves in the solvent (water). Therefore, the oxidizing agent recrystallizes upon drying and the particles of the oxidizing agent become large and non-uniform.

Water-in-oil emulsion detonating explosives are known in the field of detonating explosives. In a water-in-oil emulsion detonating explosive, an oxidizing agent is present in the form of droplets having a diameter of about 1 μm. Japanese Laid-Open Patent Publication No. 2000-143380 discloses a technique in which a water-in-oil emulsion comprising an aqueous solution of oxidizing agent and liquid fuel is prepared, a resin balloon and a water-absorbing substance, such as cross-linked sodium polyacrylate, are added thereto, and the mixture is poured into an iron chamber to freeze at −196° C. with liquid nitrogen, thereby destroying the emulsion to crystallize the oxidizing agent.

Japanese Laid-Open Patent Publication No. 2001-26490 discloses a water-containing detonating explosive solid composition having reduced tackiness. In the detonating explosive composition, about 50% to 90% of the oxidizing agent is recrystallized by adding, while applying ultrasonic wave, a thickener, such as polyacrylamide, to a water-in-oil emulsion comprising an oxidizing agent, a fuel and an emulsifying agent, and then standing to cool. The oxidizing agent in the detonating explosive has a particle size of 5 to 50 μm.

However, in the technique described in Japanese Laid-Open Patent Publication No. 2000-143380, the water-absorbing substance absorbs water discharged upon the destruction of the emulsion and prevents crystallization of the oxidizing agent which proceeds in the presence of water. According to this action, a uniform particle size is maintained for a long time. Examples of Japanese Laid-Open Patent Publication No. 2000-143380 suggest that by using a water-absorbing substance having a particle size of 200 to 300 μm or 1.5 mm, an oxidizing agent having an average particle size of 5 to 10 μm was obtained. Even if the particle size of the oxidizing agent is small, the obtained material is not preferable because the size of the particles of the ingredient constituting the explosive material composition is not uniform due to the presence of water-absorbing substance of which the size has become larger than the initial size because of water absorption and swelling. Since this water-absorbing substance is locally present and not forming gel, it does not function as a binder. In addition, since Japanese Laid-Open Patent Publication No. 2000-143380 uses a water-absorbing substance, a drying step for removing water is not suggested.

As in Japanese Laid-Open Patent Publication No. 2000-143380, the thickener used for the detonating explosive composition of Japanese Laid-Open Patent Publication No. 2001-26490 absorbs water separated from the detonating explosive and/or coming from outside by scattering semi-swelled powder of the thickener. The composition contains more than 10% of non-recrystallized portions and the particle size of the oxidizing agent is not uniform, ranging from 5 to 50 μm, and therefore, the composition is not preferable as an explosive material composition.

In addition, the detonating explosive compositions described in Japanese Laid-Open Patent Publication No. 2000-143380 and Japanese Laid-Open Patent Publication No. 2001-26490 are water-in-oil emulsion detonating explosives and contain about 4 to 8 mass % of water. Therefore, the composition has low combustion property and low mechanical strength, and cannot be used as an explosive.

SUMMARY OF THE INVENTION

An object of the present invention is to provide an explosive material composition containing particles of a water-soluble reactive ingredient which have a nearly uniform particle size and a method for producing the same.

To achieve the above-mentioned object, the inventors of the present invention have conducted intensive studies on the production of fine particles of various solid reactive ingredients that are useable in explosive material compositions. They found that solid reactive ingredients are maintained a uniform particle for a long time, by once forming a water-in-oil emulsion in which droplets of an aqueous solution of the solid reactive ingredient are dispersed, mixing the emulsion with a thickener and then drying. In addition, they found that the dried emulsion has a moderate mechanical strength and can be processed by molding.

One aspect of the present invention is an explosive material composition including a dried substance prepared by drying a water-in-oil emulsion containing a water-soluble solid reactive ingredient as an active ingredient of the explosive material composition, an oil ingredient and a thickener. The dried substance includes an agglomerate which is formed by particles of the water-soluble solid reactive ingredient. Each particle is coated with at least one of the oil ingredient and the thickener.

Another aspect of the present invention is an explosive material composition including a particle of a water-soluble reactive ingredient as an active ingredient of the explosive, an oil ingredient, and a thickener. Each particle of the reactive ingredient is coated with at least one selected from the oil ingredient and the thickener. The coated particles form an agglomerate.

Another aspect of the present invention is an explosive grain including an agglomerate of particles. Each particle includes a core of a water-soluble reactive ingredient as an active ingredient of the explosive, and a coating film coating the core, the coating film containing at least one selected from an oil ingredient and a thickener.

Another aspect of the present invention is a method for preparing an explosive material composition. The method includes preparing an aqueous solution of a water soluble solid reactive ingredient, mixing the aqueous solution with an oil ingredient and a thickener to form a water-in-oil emulsion, and drying the emulsion.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENT

Figure 1:
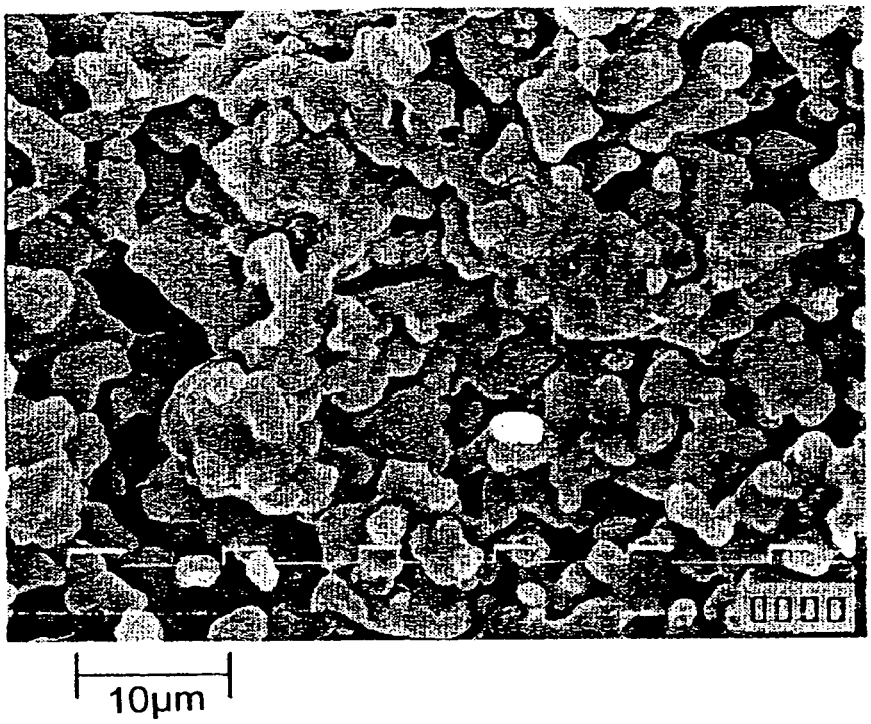
FIG. 1 is a micrograph of an explosive material composition of Example 1 of the present invention.

A preferred embodiment of the present invention will now be discussed in detail.

An explosive material composition of a preferred embodiment is prepared by drying a water-in-oil (W/O type) emulsion that contains liquid droplets of a water-soluble reactive ingredient, an oil ingredient and a thickener. The water-soluble reactive ingredient serves as an active ingredient of an explosive. The liquid droplets of the water-soluble reactive ingredient are dispersed in the emulsion.

The explosive material composition contains solid particles of the water-soluble reactive ingredient, an oil ingredient and a thickener. Each particle of the water-soluble reactive ingredient is coated with the oil ingredient and/or the thickener. The coated particles form an agglomerate. The explosive material composition can be used as an explosive as it is. In one embodiment, the water-soluble reactive ingredient is a solid substance.

In order to fulfill requirements of properties of explosives, such as burn rate, combustion pressure, combustion temperature, specific thrust, and storage stability, an additional ingredient may be mixed with the explosive material composition. Type and amount of the additional ingredient can be determined in consideration of oxygen balance, which relates to the kind of gases generated by the explosive, properties and shape of the explosive.

The particle size of the water-soluble reactive ingredient is usually in the range of 0.5 to 5 μm, and the particles are almost uniform. When the particle size is less than 0.5 μm, production tends to be complicated and when the particle size is more than 5 μm, the surface area of the particle becomes small and the combustion property of the explosive decreases.

The explosive material composition is molded into grains of a predetermined shape depending on required properties, such as burn rate, combustion pressure, and combustion temperature. Examples of shapes of the grain include a columnar, a pellet, a plate, a ball and a tube. The combustion property of the explosive material composition can be adjusted by molding. The grain is preferable because it is easy to handle when loading the explosive material composition in a container as compared with powder. For example, the container is not clogged and dusts are not generated during loading the grain.

Water content of the explosive material composition is preferably less than 2 mass %, more preferably less than 1 mass %, particularly preferably less than 0.5 mass %. The water content of more than 2 mass % is not preferable because mechanical strength of the grain of the explosive material composition is degraded, the grains are destroyed or the predetermined combustion property is not exhibited in some applications. For reducing water content of the explosive material composition to a large extent, a drying apparatus for generating extremely severe drying conditions becomes necessary, and from an economical viewpoint, the lower limit of water content is preferably 0.1 mass %. Water content is related to crystallization degree of the water-soluble reactive ingredient. For example, as shown in Comparative Example 3, when the water-soluble solid reactive ingredient is ammonium nitrate, water content of the explosive material composition corresponding to crystallization degree of ammonium nitrate of about 90% is 4 mass %. When water content of the explosive material composition is less than 2 mass %, crystallization degree of ammonium nitrate is more than 95%. When water content of the explosive material composition is less than 1 mass %, crystallization degree of ammonium nitrate is more than 97%.

Next, the water-soluble reactive ingredient will now be discussed. The reactive ingredient is an active ingredient of the explosive material composition which generates gas by oxidation or heat by combustion reaction. The reactive ingredient is preferably a solid and includes an oxidizing agent and a fuel. By "water-soluble" is meant that the reactive ingredient is soluble in water or hot water. Heating avoids crystallization of the water-soluble reactive ingredient, increases the amount of the reactive ingredient in the explosive material composition, and makes the production of the emulsion easier because viscosity of oil ingredient is decreased.

The oxidizing agent which functions as a water-soluble reactive ingredient is a substance which generates gas during oxidation reaction. The oxidizing agent may be one kind or a mixture of several kinds can also be used. In the case of a mixed oxidizing agent, at least one kind of the oxidizing agent is water-soluble. When a water-insoluble oxidizing agent is concurrently used. The ratio of the water-insoluble oxidizing agent in the oxidizing agent is preferably less than 50 mass %.

Examples of the oxidizing agent include nitrates, nitrites and oxohalogens of any one of alkali metals, alkaline earth metals and ammoniums; and basic nitrates. Examples of nitrates include sodium nitrate, potassium nitrate, calcium nitrate, strontium nitrate, barium nitrate, magnesium nitrate and ammonium nitrate. Examples of nitrites include sodium nitrite, calcium nitrite and ammonium nitrite. Examples of oxohalogens include potassium chlorate, barium perchlorate, ammonium perchlorate and potassium perchlorate. Examples of basic nitrates include basic copper nitrate, basic zinc nitrate and basic cobalt nitrate. Of these, from the viewpoint of combustion property of the explosive material composition, at least one selected from ammonium nitrate, sodium nitrate and ammonium perchlorate is preferable. When using ammonium nitrate, phase-stabilized ammonium nitrate containing a phase stabilizer such as potassium nitrate is usable.

The fuel which functions as a water-soluble reactive ingredient is a substance which generates heat during combustion reaction and has an oxygen balance of 0 or a negative number. Examples of the fuel include hydrazine nitrate and guanidine nitrate. In addition to guanidine nitrate, guanidine derivatives such as mono-, di- or triaminoguanidine nitrate, carbonate guanidine, nitroguanidine and nitroaminoguanidine nitrate may also be used.

An oxidizing agent and a fuel may be concurrently used. In addition, a water-soluble combustion catalyst, a water-insoluble combustion catalyst, a powdery finely crystallized carbon or an additional fuel may be mixed. Examples of the water-soluble or water-insoluble combustion catalyst include an organic compound containing alkali metal such as sodium fumarate and potassium tartrate. Examples of the additional fuel include activated carbon, carbon black, acetylene black and charcoal. The water-soluble combustion catalyst is preferably used from the viewpoint of combustion reaction of the explosive material composition. The reason therefor is that the water-soluble combustion catalyst dissolves in an aqueous solution of the solid reactive ingredient which is dispersion phase, in the water-in-oil emulsion, and therefore the combustion catalyst is present in or around particles of the water-soluble reactive ingredient after drying the emulsion.

The mixing ratio of the water-soluble reactive ingredient is preferably determined so that oxygen balance becomes about 0 in view of combustion property and the generation of gas. However, when the kind of the gas to be generated is not important, the mixing ratio of the water-soluble reactive ingredient may be determined so that the oxygen balance becomes a positive value or a negative value. The ratio of the water-soluble reactive ingredient in the explosive material composition varies depending on the kind thereof, but is preferably 50 to 98 mass %, more preferably 60 to 97 mass %. When the explosive material composition is used as an explosive directly without adding an additional ingredient and the ratio of the water-soluble reactive ingredient is less than 50 mass %, the oxygen balance becomes a large negative value, which is disadvantageous in terms of combustion property and the generation of gas. On the other hand, when the ratio is more than 98 mass %, preparation of the emulsion is difficult.

Next, the thickener will be discussed.

In the water-in-oil emulsion, fine droplets of the water-soluble reactive ingredient are dispersed in an oil ingredient. Specifically, in the water-in-oil emulsion, the thickener and the oil ingredient are present around the droplets of the water-soluble reactive ingredient to maintain the droplets size. In addition, the thickener and the oil ingredient prevent the droplets of the water-soluble reactive ingredient from adhering with each other and prevent the water-soluble reactive ingredients from directly agglomerating with each other. In a preferred embodiment of the explosive material composition, the surface of the droplets of each water-soluble reactive ingredient is coated with the thickener and/or the oil ingredient. Therefore, the explosive material composition contains an agglomerate in which a coating film of an oil ingredient and/or a thickener is present between the particles of the water-soluble reactive ingredient. In other words, an agglomerate in which particles of water-soluble reactive ingredient are in direct contact is not formed.

The oil ingredient and/or the thickener coat the entire surface or part of the surface of the droplets of the dispersion phase (water-soluble reactive ingredient) when preparing the emulsion, adding the thickener and drying the emulsion. For example, the coating film of the oil ingredient and/or the thickener may have fine pores formed upon vaporization of water in the water-soluble reactive ingredient. In consideration of hygroscopic property of the explosive material composition, it is preferable that the entire surface of the particles of the water-soluble reactive ingredient is coated with the thickener and/or the oil ingredient.

The thickener acts as a binder for the particles of the water-soluble reactive ingredient in addition to the above-mentioned effect of maintaining the particle size. The thickener also has a function which enables production of grains by an extruding method. On the other hand, the oil ingredient acts as a flowability improving agent or a lubricating property improving agent. The oil ingredient improves extruding property when an extruding method is used as the molding method and functions as a lubricant in the case of using a pelletizing (pressing) method, making it unnecessary to add an additional lubricant when molding.

The thickener is a synthesized or natural high molecular substance which dissolves or becomes gel in water at room temperature, or in cooled or heated water. In particular, a high molecular substance which becomes gel after drying to coat the particles of the water-soluble reactive ingredient is preferable. Thus, the thickener becomes gel. Specific examples thereof include cellulose derivatives such as a sodium salt of carboxymethyl cellulose, hydroxyl propyl cellulose and hydroxylethyl cellulose; polyvinyl compounds such as poly (vinyl alcohol), polyvinyl methyl ether, polyvinyl pyrrolidone and polyvinyl caprolactam; polyacrylamide; polyacrylic acid compounds such as sodium polyacrylate; polyalkylene glycols such as polyethylene glycol; polysaccharides such as gum guaiac, gum arabic, xanthan gum, starch, pullulan and a sodium salt of an alginic acid, or a salt thereof; casein sodium; proteins such as gelatin; carrageenan; agar; pectin; and cyclodextrin. In addition, a crosslinked compound thereof can also be used. These thickeners can be used alone or in a mixture of at least two kinds thereof. Of the above thickeners, at least one kind selected from cellulose derivatives, polyvinyl compounds, polyalkylene glycol and polysaccharides is preferable from the viewpoint of economical efficiency and handling property.

When coating the particles of the water-soluble reactive ingredient with the thickener, the thickener may crosslink the particles. When crosslinked, the particle size can be maintained in a stable state for a long period of time. The smaller the particle size of the thickener the better to be dissolved and gelatinized easily, and the particle size is usually less than 200 μm, preferably less than 150 μm. The lower limit of the particle size of the thickener is possibly about 10 μm because of the production. The mixing ratio of the thickener in the water-in-oil emulsion is preferably 1 to 50 mass %, more preferably 3 to 30 mass %. When the mixing ratio is less than 1 mass %, the effect of maintaining the particle size of the solid reactive ingredient tends to be poor. Even if mixing ratio exceeds 50 mass %, the above-mentioned effect of the thickener cannot be improved correspondingly, and unpreferably, the ratio of the solid reactive ingredient in the explosive material composition becomes relatively small.

Next, the oil ingredient used for preparing the water-in-oil emulsion will be discussed.

As the oil ingredient, a water-insoluble oil is usually used to form a water-in-oil emulsion. As the oil, all oil used for emulsion detonating explosives can be used. Of these, an oil that is a solid at room temperature, i.e., having a melting point or a softening point of more than 20° C., is preferable from the viewpoint of handling property when an explosive material composition is prepared. For example, various waxes are used. The oil ingredient is used alone or in a mixture of two or more kinds depending on conditions of preparing the emulsion.

In addition to the oil, the oil ingredient may be a reactive substance incompatible with water, such as a monomer or an organic substance-containing liquid having a reactive functional group. A polymerization reaction, an addition reaction and a condensation reaction can also be conducted by using the reactive substance. In such case, the oil ingredient has a relatively high molecular weight and having a melting point or a softening point more than 20° C. Further, by using as an oil ingredient a liquid obtained by dissolving a polymer having a melting point or a softening point of more than 20° C. in an organic solvent incompatible with water, and by removing the organic solvent by drying, the melting point or the softening point of the residual oil ingredient can be adjusted to more than 20° C.

The ratio of the oil ingredient is usually 0.5 to 10 mass % in the water-in-oil emulsion. When the ratio is less than 0.5 mass %, preparation of the emulsion tends to be difficult and therefore the particles of the water-soluble reactive ingredient tend to be uneven. On the other hand, when the ratio is more than 10 mass %, the oxygen balance becomes a large negative value, and when the explosive material composition is used as an explosive as it is, decrease in the combustion property and the property of the generated gas is unpreferably caused.

A surfactant is used to form a water-in-oil emulsion by dispersing (emulsifying) particles of a water-soluble reactive ingredient in an oil ingredient. As the surfactant, those usually used for preparing a water-in-oil emulsion are used. Examples of such surfactant include a sorbitan surfactant which is excellent in emulsion stability. The surfactant is used alone or in a mixture of two or more kinds. The ratio of the surfactant in the water-in-oil emulsion is usually 0.5 to 5 mass %. When the ratio is less than 0.5 mass %, the stability of the emulsion becomes poor. In this case, the droplets in the water-in-oil emulsion tend to become non-uniform, making the particle size of the water-soluble reactive ingredient non-uniform after drying the emulsion. On the other hand, when the ratio is more than 5 mass %, the emulsifying effect does not increase correspondingly, affecting the combustion property.

When a reactive substance is used as the oil ingredient in addition to the surfactant, a surfactant having a reactive functional group, i.e., a reactive surfactant may be used. The reactive surfactant is also used for the purpose of carrying out a polymerization reaction, an addition reaction or a condensation reaction of the reactive substance as well as for the preparation of emulsion. Therefore, the ratio of the reactive surfactant is determined based on the number of the reactive functional groups per 1 mole of the reactive substance and the moles of the reactive substance added to prepare an emulsion.

The total amount of the thickener and the oil ingredient in the water-in-oil emulsion is preferably 2 to 50 mass %. When the total amount is less than 2 mass %, the particle size of the water-soluble reactive ingredient tends to be uneven, and when the total amount is more than 50 mass %, the ratio of the water-soluble reactive ingredient becomes small, which is a disadvantage for the explosive material composition. The explosive material composition can be used as an explosive directly, but an additional ingredient may be compounded where necessary. As the additional ingredient, for example, binders including high energetic binders, such as glycidylazide polymers (GAP) and nitrocellulose, polybutadiene polymers, cellulose acetate, cellulose acetate butyrate, thermoplastic elastomers; oxidizing agents for adjusting the oxygen balance; antistatic agents for preventing charging of the grain; combustion catalysts, such as metal oxide including iron oxide, boron and aluminum; water-insoluble oxidizing agents other than those described above, such as triaminoguanidine nitrate, cyclomethylenetrinitramine (RDX) and cyclomethylenetetranitramine (HMX); slag forming agents such as aluminum oxide; lubricants such as magnesium stearate; heat reducing agents such as magnesium oxide; stabilizers; and colorants; can be used in view of the properties required for explosives. The mixing ratio of the additional ingredient is appropriately determined based on a usual method depending on the use of the explosive.

Next, the method for producing the explosive material composition and an action thereof will be discussed referring to preferred embodiment.

First, as an emulsifying step, an aqueous solution of a water-soluble reactive ingredient is prepared. The aqueous solution of a water-soluble reactive ingredient and an oil ingredient is stirred. At this stage, preparation under heating can improve the dispersibility of the water-soluble reactive ingredient in the oil ingredient and quick preparation of the emulsion is achieved. Subsequently, a thickener is added to the water-in-oil emulsion and mixing is conducted. After drying this mixture or molding into a predetermined shape in the molding step, the resulting material is dried in the drying step to give a dried substance of the emulsion, which is the explosive material composition. Alternatively, the explosive material composition can be prepared also by granulating before drying the emulsion and then drying and molding.

In this case, the thickener becomes gel in the water-in-oil emulsion by absorbing water from the dispersed droplets and covers the periphery of the droplets. The adhesion of droplets themselves does not occur and the water-soluble reactive ingredient contained in the droplets is recrystallized while the size of the droplets being maintained. As described above, since the particles of the water-soluble reactive ingredient are fixed in the thickener which has been gelated, growth of the crystal does not occur. As a result, the particle size of the water-soluble reactive ingredient remains uniform in the range of 0.5 to 5 μm, and an agglomerate is formed in which the oil ingredient and the thickener are present between the particles of the water-soluble reactive ingredient.

The emulsifying step of forming an emulsion is a step of making fine particle of droplets of the water-soluble reactive ingredient. In the emulsifying step, a usual high speed stirrer can be used and the stirring conditions can be determined accordingly based on the kind of the water-soluble reactive ingredient or the viscosity of the emulsion. The molding method is not particularly limited, but the former is suitable for an extruding method and the latter is suitable for a pelletizing (pressing) method. As described above, there is no problem if another step such as molding is included before drying.

The drying step is a step for dehydration and precipitation of crystals of the water-soluble reactive ingredient. The step also involves coating of the particles of the water-soluble reactive ingredient with an oil ingredient or a thickener, or transition thereof to the periphery of the particles, and this is also a step for curing the grains. The drying method is preferably heating, treatment under reduced pressure or a combination thereof, but a freeze-dry method is not appropriate. The water content of the explosive material composition obtained through the drying step is less than 2 mass %. The obtained explosive material composition is almost homogeneous due to drying in the agglomerate state, and therefore coagulation of particles of the water-soluble reactive ingredient can be avoided and the change in the particle size due to adhesion of the particles of the water-soluble reactive ingredient can be suppressed.

The preferred embodiment has the following advantages.

The explosive material composition is obtained by drying a water-in-oil emulsion containing a water-soluble reactive ingredient such as ammonium nitrate which functions as an active ingredient of the explosive material composition and a thickener such as a sodium salt of carboxymethyl cellulose. In the water-in-oil emulsion, the droplets of the water-soluble reactive ingredient are coated with an oil ingredient or a thickener. The droplets are dried and formed into particles of the water-soluble reactive ingredient. In the dried substance of the emulsion, i.e., an explosive material composition, each particle of the water-soluble reactive ingredient is coated with an oil ingredient and/or a thickener. That is, the core of the water-soluble reactive ingredient is coated with a coating film of oil ingredient and/or thickener. The coated particles form an agglomerate. The change in particle size due to adhesion of the particles of the water-soluble reactive ingredient is inhibited mainly by the action of the thickener. In addition, since direct coagulation of particles does not occur, the particles of the water-soluble reactive ingredient can be present in the emulsion in a stable state.

Accordingly, the explosive material composition comprised of the dried substance of the emulsion contains particles of the water-soluble reactive ingredient having a uniform particle size and has superior mechanical strength. According to this, properties required for the use as an explosive material composition can be satisfied. Although the explosive material composition contains a water-soluble reactive ingredient which is high in hygroscopic property, the explosive material composition is also suitable for extrusion molding or press molding, because the ingredient exists in the form of uniform fine particles. Accordingly, the explosive material composition can be used as it is or after mixing with other ingredients, or after being molded if necessary, suitably for a gun propellant, a propellant, a gas generating agent for protecting those on board a vehicle and a pyrotechnic composition.

Grains formed by molding the explosive material composition into a column or a ball shape are preferable for exhibiting the predetermined combustion property. This also improves handling property upon loading the explosive material composition in the container.

When the water content of the explosive material composition is less than 2 mass %, the combustion property and the strength of the explosive obtained from the explosive material composition are improved.

The water-soluble reactive ingredient comprises an oxidizing agent and/or a fuel which generate gas. The oxidizing agent is at least one selected from nitrates, nitrites and oxohalogens of any one of alkali metals, alkaline earth metals and ammonium; and basic nitrates. The explosive manufactured using the explosive material composition having this composition generates gas upon burning and can be used for a gas generating agent for protecting those on board including airbag systems.

When the thickener is at least one selected from cellulose derivatives, polyvinyl compounds, polyalkylene glycols and polysaccharides, the particle size of the water-soluble reactive ingredient can be maintained further uniformly and in addition, the molding ability of the explosive material composition improves.

The oil ingredient means oils and surfactants; the amount of the water-soluble reactive ingredient in the explosive material composition is 50 to 98 mass %; and the total amount of the thickener and the oil ingredient is 2 to 50 mass %. In that case, the water-soluble reactive ingredient becomes particles in the water-in-oil emulsion. The surface of the particles is coated with an oil ingredient, or an oil ingredient and a thickener. According to this, the particle size is maintained by the oil ingredient, or the oil ingredient and the thickener. As a result, a water-in-oil emulsion in which fine particles of the water-soluble reactive ingredient are homogeneously dispersed can be formed.

The explosive material composition is prepared by emulsifying an aqueous solution of water-soluble reactive ingredient and an oil ingredient to form a water-in-oil emulsion, adding to the water-in-oil emulsion a thickener and mixing, and by drying the mixture. The drying method is preferably heating, depressuring or a combination of heating and depressuring. In the explosive material composition prepared in this way, the water-soluble reactive ingredient is present in the form of fine particles having a uniform particle size. According to this, the explosive material composition has excellent mechanical strength and exhibits properties required for explosives.

In the following, Examples and Comparative Examples are explained. In each Example and Comparative Example, part(s) and % are used as a standard for mass.

Example 1

83 parts of nitrate ammonium was added to 12 parts of water and dissolved by heating to obtain an aqueous oxidizing agent solution of about 90° C. A mixture of 1.7 parts of paraffin wax, 0.8 parts of microcrystalline wax and 2.5 parts of sorbitan fatty acid ester surfactant was heated and melted to obtain an oil ingredient of 92° C. A heat-insulated container was charged with the oil ingredient. The aqueous oxidizing agent solution was gradually added to the oil ingredient and the mixture was stirred at 600 rpm for 1 minute and 1600 rpm for 1 minute using a propeller blade stirrer to obtain a water-in-oil emulsion of about 90° C. The water-in-oil emulsion was cooled to room temperature. To 100 parts of the water-in-oil emulsion was added 25 parts of sodium salt of carboxymethyl cellulose (available from Nacalai Tesque, Inc., average particle size 65 μm) functioning as a thickener, and mixing was conducted using a mixer to obtain a mixture.

A part of the mixture was vacuum dried at 50° C. for 4 days to obtain a dry substance, an explosive material composition. FIG. 1 is a micrograph showing the explosive material composition. The magnification is 2000 times power. It was found that particles of ammonium nitrate have a particle size ranged from 1 to 3 μm and that each particle is coated with the oil ingredient and the thickener and that the coated particles form an agglomerate.

Drawing was conducted using the above-mentioned mixture by a handpress to prepare a column strand sample having a diameter of 4 mm and a length of 130 mm. The extrusion property of the mixture was excellent. The sample was vacuum dried at 50° C. for four days to obtain a dried explosive material composition. The water content of the explosive material composition as measured by the Karl Fischer method (JIS K0068) was 0.25%. The density of the explosive material composition was 1.41 g/cm$^3$.

The burn rate of the explosive material composition was measured using a chimney-type strand combustion chamber. Specifically, the linear burn rate was calculated according to a fuse breaking method, by setting the sample in a nitrogen atmosphere of a pre-determined pressure and igniting the one end of the sample using nichrome wire. The edge of the strand was coated with a flame retardant so that the combustion proceeds vertically to the sample surface. The burn rate was 3.5 mm/sec and 13.3 mm/sec at a pressure of a nitrogen atmosphere of 9.8 MPa and 19.6 MPa, respectively.

A column-shaped explosive having a diameter of 3 mm and a length of 4 mm was prepared by extruding by a handpress using the above-mentioned mixture. The sample was heated and vacuum dried in the same manner as mentioned above and an explosive material composition was obtained. The water content of the explosive material composition was 0.30%. The explosive material composition was compressed by applying load in the longitudinal direction using a Kiya-type digital hardness tester made by Fujiwara Scientific Company to examine the strength. The explosive material composition was compressed by a stamper having a diameter of 5 mm at a rate of 1 mm/sec. The compression strength was 14.8 MPa.

Example 2

73 parts of ammonium nitrate and 10 parts of guanidine nitrate were added to 12 parts of water and dissolved by heating to obtain a mixed aqueous solution of an oxidizing agent and a fuel of about 90° C. A mixture of 2.5 parts of microcrystalline wax and 2.5 parts of sorbitan fatty acid ester surfactant was heated and melted to obtain an oil ingredient of 92° C. Then, emulsification was conducted under the same conditions as in Example 1 to obtain a water-in-oil emulsion. The water-in-oil emulsion was cooled to room temperature. Subsequently, 10 parts of sodium salt of carboxymethyl cellulose was added to 100 parts of water-in-oil emulsion and mixing was conducted using a mixer. Thereto was added 1.7 parts of activated carbon which is a reducing agent, followed by mixing and a mixture was obtained.

The mixture was granulated using a 500 μm mesh standard sieve (JIS 8801-1) and the granules were dried at 105° C. for 4 hours to obtain an explosive material composition. The water content of the obtained explosive material composition was 0.69%. When examined under a microscope, the explosive material composition (granulated explosive) was confirmed to be agglomerates in which particles having a size of less than 5 μm are combined via the oil ingredient and the thickener.

3 g of the explosive material composition was pressed under a pressure of 370 MPa to prepare a strand sample. In the pressing, lubricant was not necessary. The density of the strand sample was 1.57 g/cm$^3$. The burn rate of the strand sample was 4.2 mm/sec at a pressure of 12.3 MPa and 7.8 mm MPa at a pressure of 19.6 MPa.

Example 3

A mixture was obtained in the same manner as in Example 1 except that 10 parts of polyvinyl pyrrolidone (Luvitec K90, available from BASF) was used instead of sodium salt of carboxymethyl cellulose and that 1.7 parts of activated carbon was added. After granulating the mixture through the same standard sieve as in Example 2, vacuum drying was conducted at room temperature for 4 days to obtain an explosive material composition. The water content of the explosive material composition was 0.30%. When examined under a microscope, the explosive material composition was found to be agglomerates in which particles having a size of less than 5 μm are combined via the oil ingredient and the thickener.

Comparative Example 1

Figure 2:
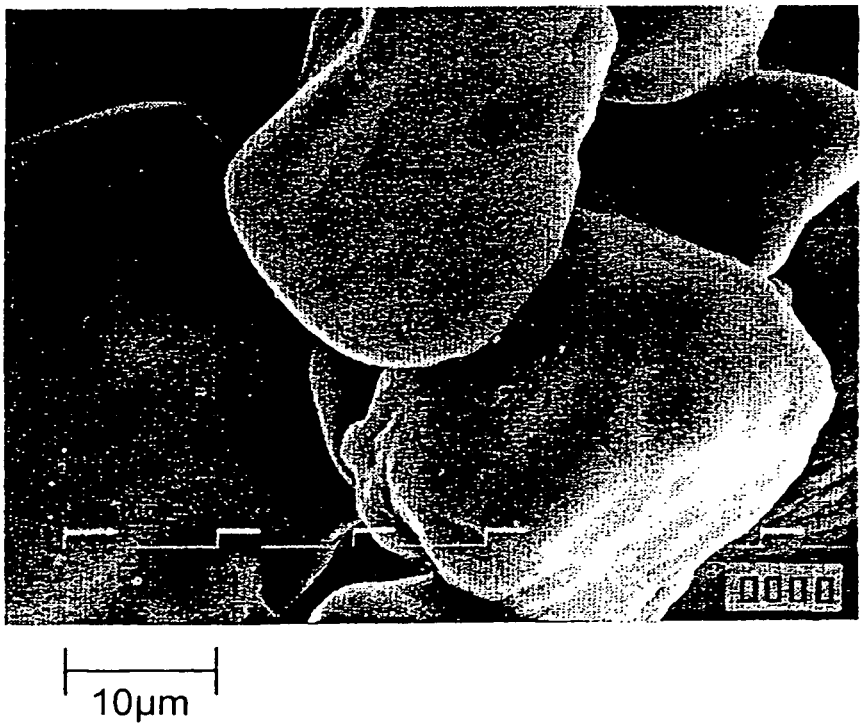
FIGS. 2 and 3 are micrographs of explosive material compositions of Comparative Examples 1 and 2, respectively.

The ammonium nitrate used in Example 1 was pulverized according to the following method. 0.5 kg of ammonium nitrate, 1 g of magnesium stearate which is an anticoagulant and 3.5 kg of alumina balls having a diameter of 21 mm were put in a ball mill having a capacity of 3.6 l. Pulverization was conducted by an acetone wet method at a rotation number of 87 rpm over 150 min. The pulverized ammonium nitrate was dried according to the same drying method as in Example 1. The obtained explosive material composition was microphotographed under the same conditions as in Example 1. The microphotograph is shown in FIG. 2. As a result, agglomerates in which the particles of ammonium nitrate having a size of 10 to 30 μm are agglomerated were found.

Comparative Example 2

Figure 3:
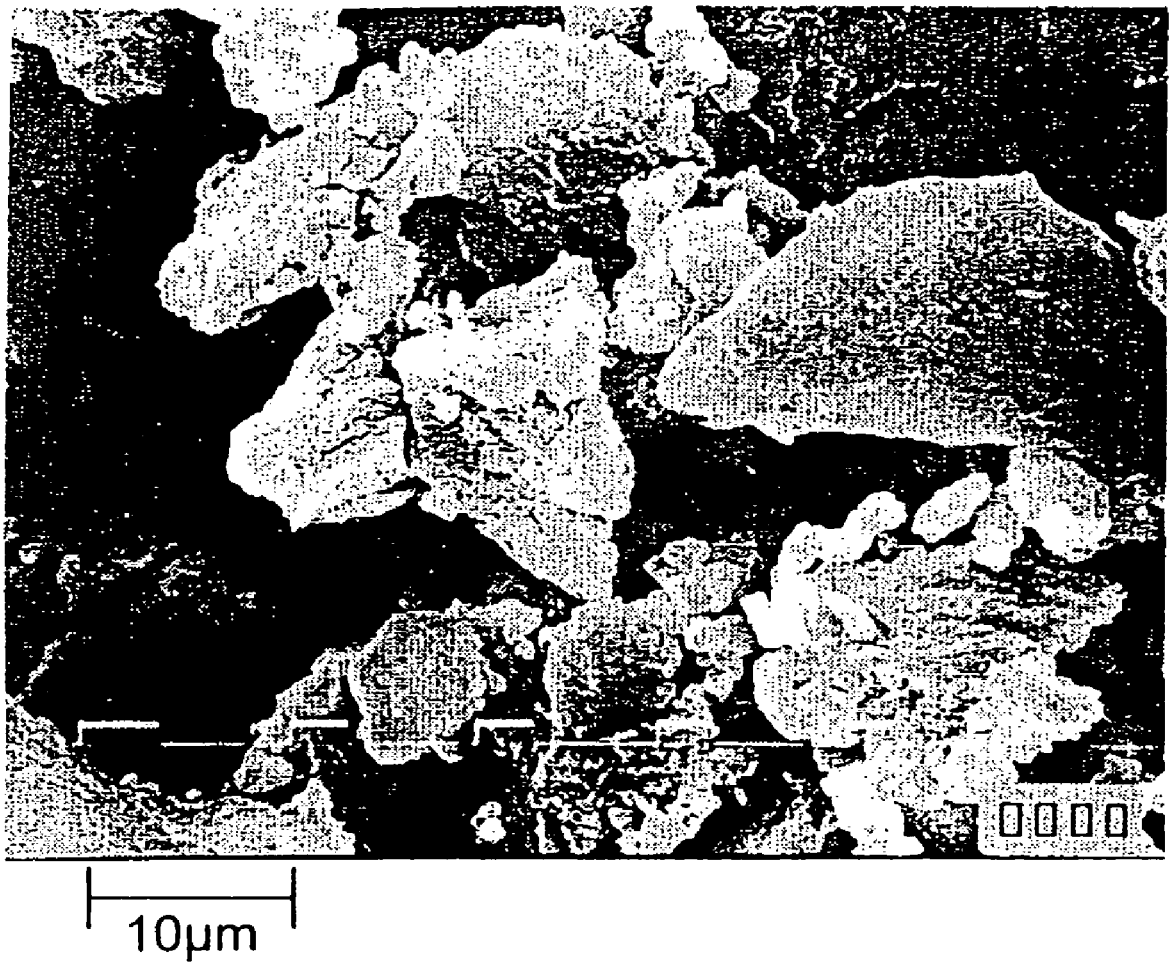

A mixture was obtained by mixing each ingredient using the same composition and the same ratio as in Example 1 except that ammonium nitrate pulverized in Comparative Example 1 was used instead of preparing an emulsion. Part of the mixture was dried in the same manner as in Example 1 and the obtained explosive material composition was microphotographed under the same conditions as in Example 1. The microphotograph is shown in FIG. 3. As a result, it has been found that the observed shape was different from the shape after pulverization and that the obtained material contained recrystallized ammonium nitrate having a size of about 1 to 50 μm.

Comparative Example 3

A water-in-oil emulsion was prepared according to Example 1, in which the water content was adjusted to 4% so that the crystallization degree became about 90% based on calculation using the data that the solubility of ammonium nitrate in 100 g of water at 25° C. is 212 g. To the emulsion was added the same thickener as in Example 1 to obtain a mixture. An explosive material composition (string-shaped explosive) having a diameter of 3 mm was obtained by extruding the mixture by a handpress without drying.

The explosive material composition was cut into a column-shaped explosive having a length of 4 mm and subjected to the same compression strength test as in Example 1. As a result, the material was deformed at a pressure of less than 0.14 MPa. In addition, the explosive material composition was cut into a length of 130 mm and subjected to a strand combustion test as in Example 1 at 9.8 MPa. This material, however, was not combustible. Upon examination of the sample after the test, only the part that contacted with the heater wire was scorched.

The preferred embodiment can be modified as follows.

The water-in-oil emulsion may be prepared by compounding a thickener to the water-soluble reactive ingredient.

The surface of the particles of the water-soluble reactive ingredient may be coated with two layers of an oil ingredient layer and a thickener layer.

The water-in-oil emulsion may be formed by adjusting the stirring rate without using a surfactant.

When the oil ingredient is a monomer, an organic substance-containing liquid having a reactive functional group, or a polymer, which are incompatible with water, such ingredient may be sublimated in the drying step. In this case, the particles of the water-soluble reactive ingredient in the explosive material composition are coated with the thickener alone.

The present examples and embodiments are to be considered as illustrative and not restrictive, and the invention is not to be limited to the details given herein, but may be modified within the scope and equivalence of the appended claims.

What is claimed is:

1. An explosive material composition for an explosive, the composition comprising:

a dried substance prepared by drying a water-in-oil emulsion containing a water-soluble solid reactive ingredient as an active ingredient of the explosive, an oil ingredient that is solid at room temperature, and a thickener, wherein the dried substance includes an agglomerate formed by particles of the water-soluble solid reactive ingredient, each particle of the water-soluble solid reactive ingredient having a nearly uniform particle size of 0.5 to 5 μm and being coated with a coating film containing both of the oil ingredient and the thickener.

2. The explosive material composition according to claim 1, which is molded into a predetermined shape.

3. The explosive material composition according to claim 1, wherein the dried substance has a water content of less than 2 mass %.

4. The explosive material composition according to claim 1, wherein the water-soluble solid reactive ingredient is at least one selected from the group consisting of an oxidizing agent and a fuel which burns when oxidized.

5. The explosive material composition according to claim 4, wherein the oxidizing agent is at least one selected from the group consisting of:

nitrates, nitrites and oxohalogens of any one of alkali metals, alkaline earth metals and ammonium; and basic nitrates.

6. The explosive material composition according to claim 4, wherein the oxidizing agent is at least one selected from the group consisting of ammonium nitrate, sodium nitrate and ammonium perchlorate.

7. The explosive material composition according to claim 1, wherein the thickener is at least one selected from the group consisting of cellulose derivatives, polyvinyl compounds, polyalkylene glycols and polysaccharides.

8. The explosive material composition according to claim 1, wherein the oil ingredient includes an oil and a surfactant which allows droplets of an aqueous solution of the water-soluble solid reactive ingredient to disperse in the oil.

9. The explosive material composition according to claim 1, wherein the ratio of the mass of the water-soluble solid reactive ingredient to the total mass of the thickener and the oil ingredient is 50:50 to 98:2.

10. The explosive material composition according to claim 1, wherein the explosive burns without detonation and generates gas or heat.

11. An explosive material composition for an explosive, the composition comprising:

particles of a water-soluble solid reactive ingredient as an active ingredient of the explosive;

an oil ingredient that is solid at room temperature; and a thickener, wherein each particle of the water-soluble solid reactive ingredient having a nearly uniform particle size of 0.5 to 5 μm and is coated with a coating film containing both of the oil ingredient and the thickener, and wherein the coated particles form an agglomerate.

12. An explosive grain comprising:

particles of a water-soluble solid reactive ingredient as an active ingredient of the explosive, each particle of the water-soluble solid reactive ingredient having a nearly uniform particle size of 0.5 to 5 μm; and a coating film coating each particle of the water-soluble solid reactive ingredient, the coating film containing both of an oil ingredient that is solid at room temperature and a thickener, where the coated particles form an agglomerate.

13. The explosive grain according to claim 12, wherein the ratio of the mass of the water-soluble solid reactive ingredient to the total mass of the thickener and the oil ingredient is 50:50 to 98:2.

14. The explosive grain according to claim 12, wherein the coating film has micropores.

15. The explosive material composition according to claim 1, wherein the oil ingredient has a melting point or a softening point of more than 20° C.

16. The explosive material composition according to claim 1, wherein the oil ingredient is a wax.

* * * * *

UNITED STATES PATENT AND TRADEMARK OFFICE

CERTIFICATE OF CORRECTION

PATENT NO. : 7,645,351 B2
APPLICATION NO. : 10/978603
DATED : January 12, 2010
INVENTOR(S) : Ohno et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 622 days.

Signed and Sealed this

Sixteenth Day of November, 2010

David J. Kappos

David J. Kappos
*Director of the United States Patent and Trademark Office*